US005544278A

United States Patent [19]

Bialik et al.

[11] Patent Number: 5,544,278

[45] Date of Patent: Aug. 6, 1996

[54] PITCH POST-FILTER

[75] Inventors: Leon Bialik; Felix Flomen, both of Rishon LeZion, Israel

[73] Assignee: Audio Codes Ltd., Or Yehuda, Israel

[21] Appl. No.: 235,765

[22] Filed: Apr. 29, 1994

[51] Int. Cl.[6] ..... G10L 3/02

[52] U.S. Cl. ..... 395/2.77; 395/2.2

[58] Field of Search ..... 381/36–39, 40, 381/49, 50; 395/2, 2.12–2.18, 2.2, 2.25–2.37, 2.67, 2.76–2.78

[56] References Cited

U.S. PATENT DOCUMENTS

| | | | |
|---|---|---|---|
| 4,969,192 | 11/1990 | Chen et al. | 395/2.31 |
| 5,293,449 | 3/1994 | Tzeng | 395/2.29 |
| 5,307,441 | 4/1994 | Tzeny | 395/2.31 |

OTHER PUBLICATIONS

Kroon et al., "A Class of Analysis–by–Synthesis Predictive Coders for High Quality Speech Coding at Rates Between 4.8 and 16 Kbits/s," IEEE Journal on Selected Areas in Commo., vol. 6, No. 2, Feb. 1988, pp. 353–363.

*Primary Examiner*—David D. Knepper
*Attorney, Agent, or Firm*—Skjervan, Morrill, MacPherson, Franklin & Friel; Forrest E. Gunnison

[57] ABSTRACT

A filter utilizes future and past information for at least some of the subframes. Specifically, the filter receives a frame of synthesized speech and, for each subframe of the frame of synthesized speech, produces a signal which is a function of the subframe and of windows of earlier and later synthesized speech. Each window is utilized only when it provides an acceptable match to the subframe.

10 Claims, 5 Drawing Sheets

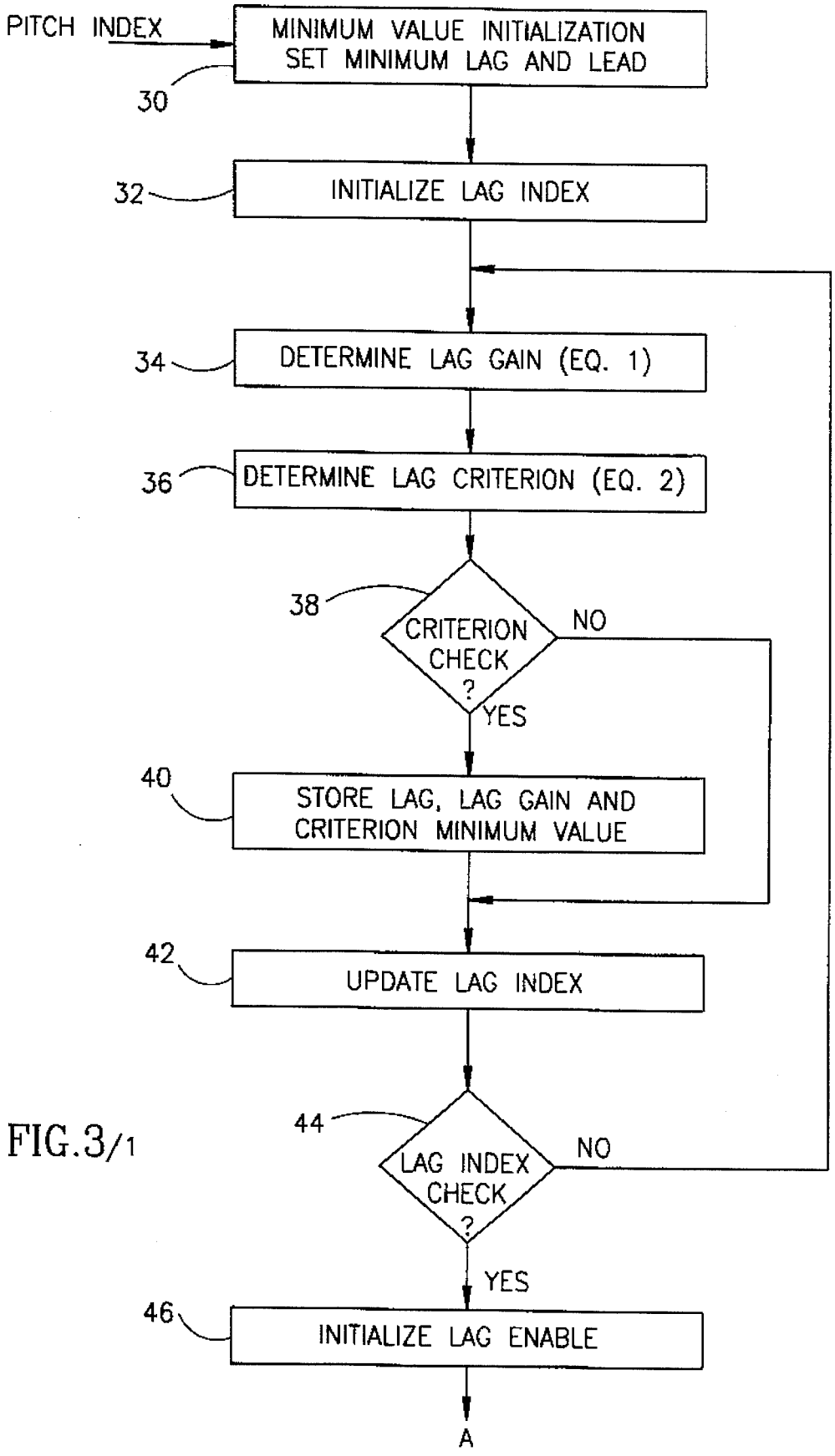
FIG.3/1

FIG.3/2
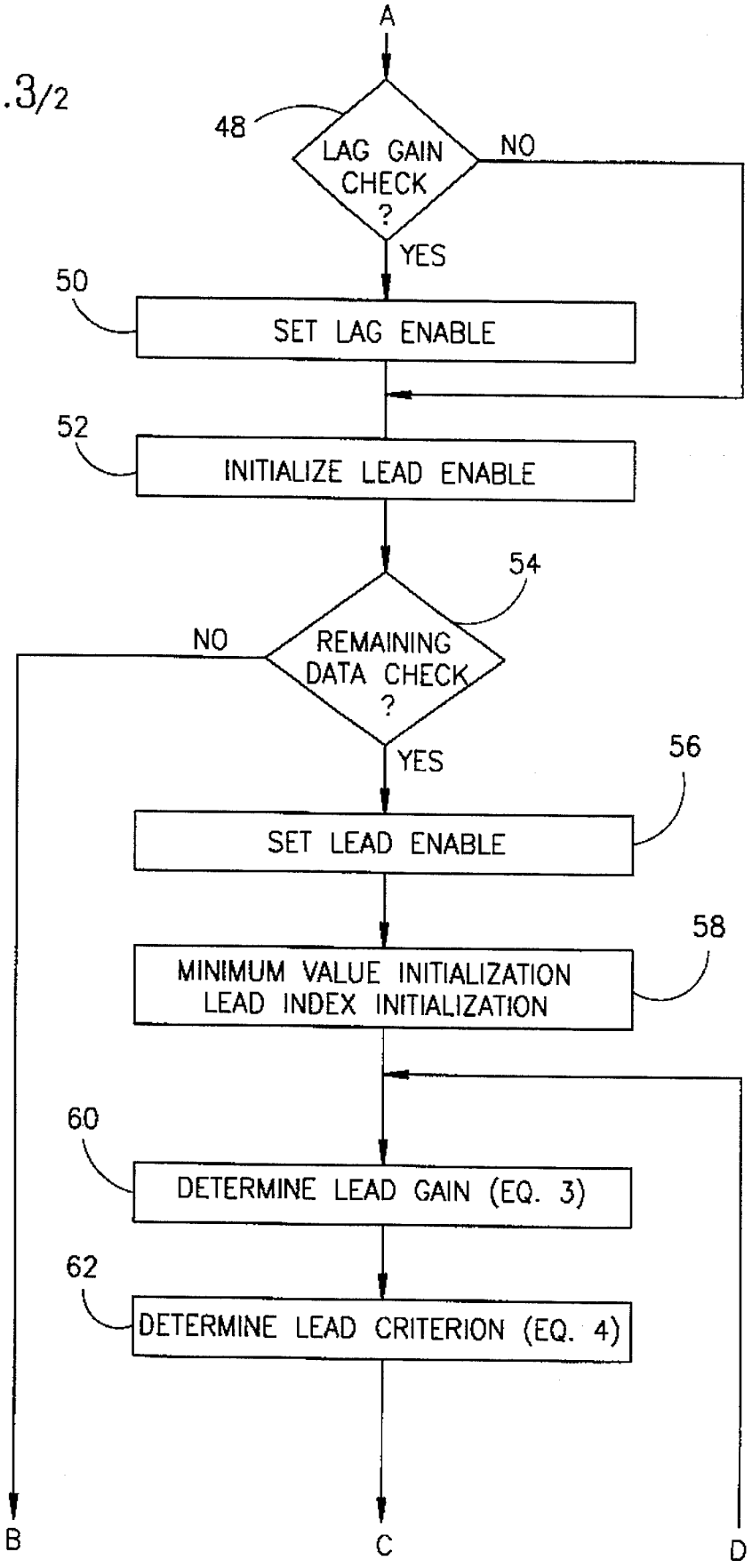

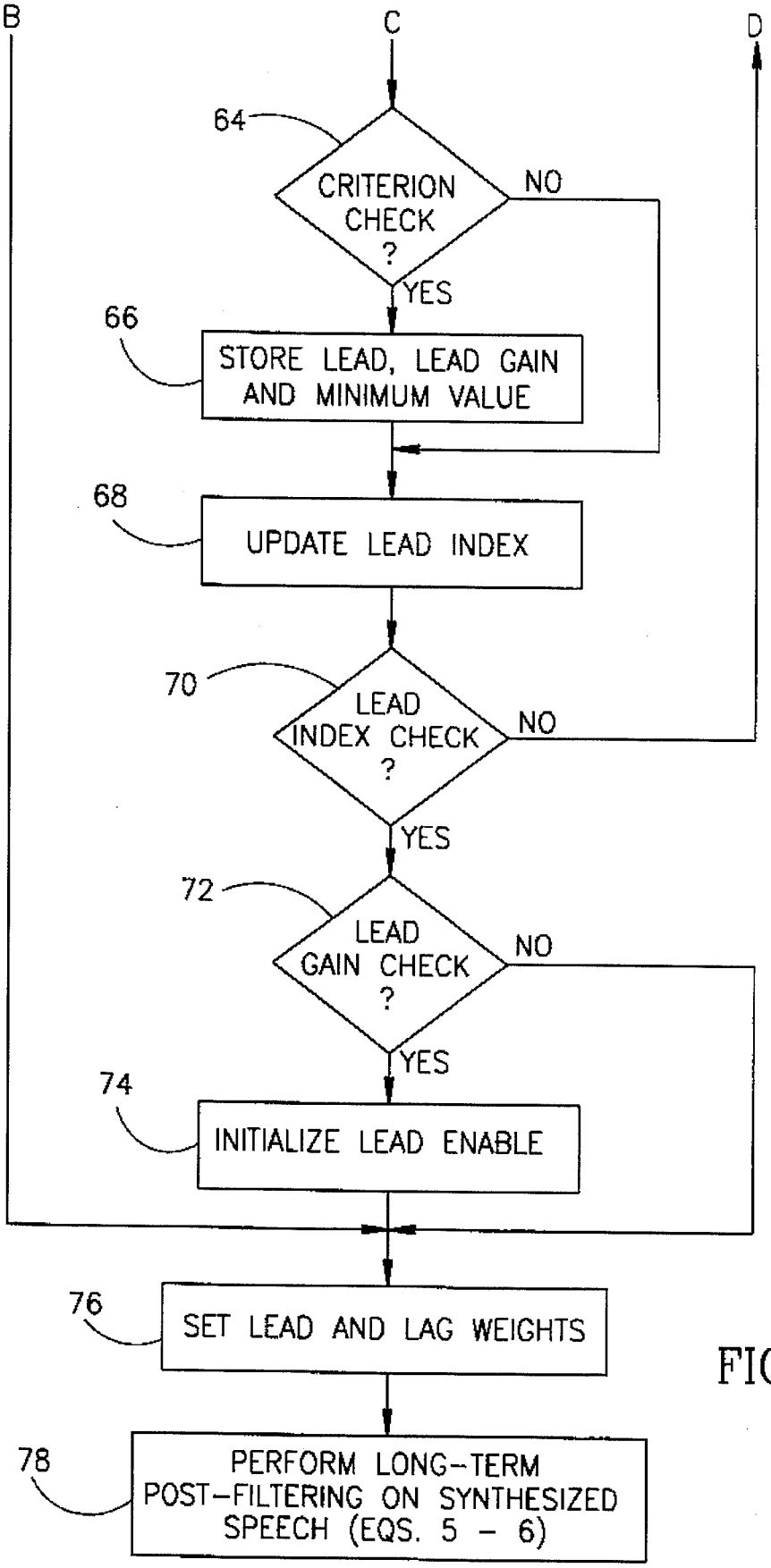
FIG.3/3

PITCH POST-FILTER

FIELD OF THE INVENTION

The present invention relates to speech processing systems generally and to post-filtering systems in particular.

BACKGROUND OF THE INVENTION

Speech signal processing is well known in the art and is often utilized to compress an incoming speech signal, either for storage or for transmission. The processing typically involves dividing incoming speech signals into frames and then analyzing each frame to determine its components. The components are then encoded for storing or transmission.

When it is desired to restore the original speech signal, each frame is decoded and synthesis operations, which typically are approximately the inverse of the analysis operations, are performed. The synthesized speech thus produced typically is not all that similar to the original signal. Therefore, post-filtering operations are typically performed to make the signal sound "better".

One type of post-filtering is pitch post-filtering in which pitch information, provided from the encoder, is utilized to filter the synthesized signal. In prior art pitch post-filters, the portion of the synthesized speech signal $p_o$ samples earlier is reviewed, where $p_o$ is the pitch value. The subframe of earlier speech which best matches the present subframe is combined with the present subframe, typically in a ratio of 1:0.25 (e.g. the previous signal is attenuated by three-quarters).

Unfortunately, speech signals do not always have pitch in them. This is the case between words; at the end or beginning of the word, the pitch can change. Since prior art pitch post-filters combine earlier speech with the current subframe and since the earlier speech does not have the same pitch as the current subframe, the output of such pitch post-filters for the beginning of words can be poor. The same is true for the subframe in which the spoken word ends. If most of the subframe is silence or noise (i.e. the word has been finished), the pitch of the previous signal will have no relevance.

SUMMARY OF THE PRESENT INVENTION

Applicants have noted that speech decoders typically provide frames of speech between their operative elements while pitch post-filters operate only on subframes of speech signals. Thus, for some of the subframes, information regarding future speech patterns is available.

It is therefore an object of the present invention to provide a pitch post-filter and method which utilizes future and past information for at least some of the subframes.

In accordance with a preferred embodiment of the present invention, the pitch post-filter receives a frame of synthesized speech and, for each subframe of the frame of synthesized speech, produces a signal which is a function of the subframe and of windows of earlier and later synthesized speech. Each window is utilized only when it provides an acceptable match to the subframe.

Specifically, in accordance with a preferred embodiment of the present invention, the pitch post-filter matches a window of earlier synthesized speech to the subframe and then accepts the matched window of earlier synthesized speech only if the error between the subframe and a weighted version of the window is small. If there is enough later synthesized speech, the pitch post-filter also matches a window of later synthesized speech and accepts it if its error is low. The output signal is then a function of the subframe and the windows of earlier and later synthesized speech, if they have been accepted.

Furthermore, in accordance with a preferred embodiment of the present invention, the matching involves determining an earlier and later gain for the windows of earlier and later synthesized speech, respectively.

Still further, in accordance with a preferred embodiment of the present invention, the function for the output signal is the sum of the subframe, the earlier window of synthesized speech weighted by the earlier gain and a first enabling weight, and the later window of synthesized speech weighted by the later gain and a second enabling weight.

Finally, in accordance with a preferred embodiment of the present invention, the first and second enabling weights depend on the results of the steps of accepting.

BRIEF DESCRIPTION OF THE DRAWINGS

The present invention will be understood and appreciated more fully from the following detailed description taken in conjunction with the drawings in which:

FIG. 3 (sheets 3/1, 3/2 and 3/3) is a flow chart illustration of the operations of the pitch post-filter of FIG. 1.

DETAILED DESCRIPTION OF A PREFERRED EMBODIMENT

Figure 1:
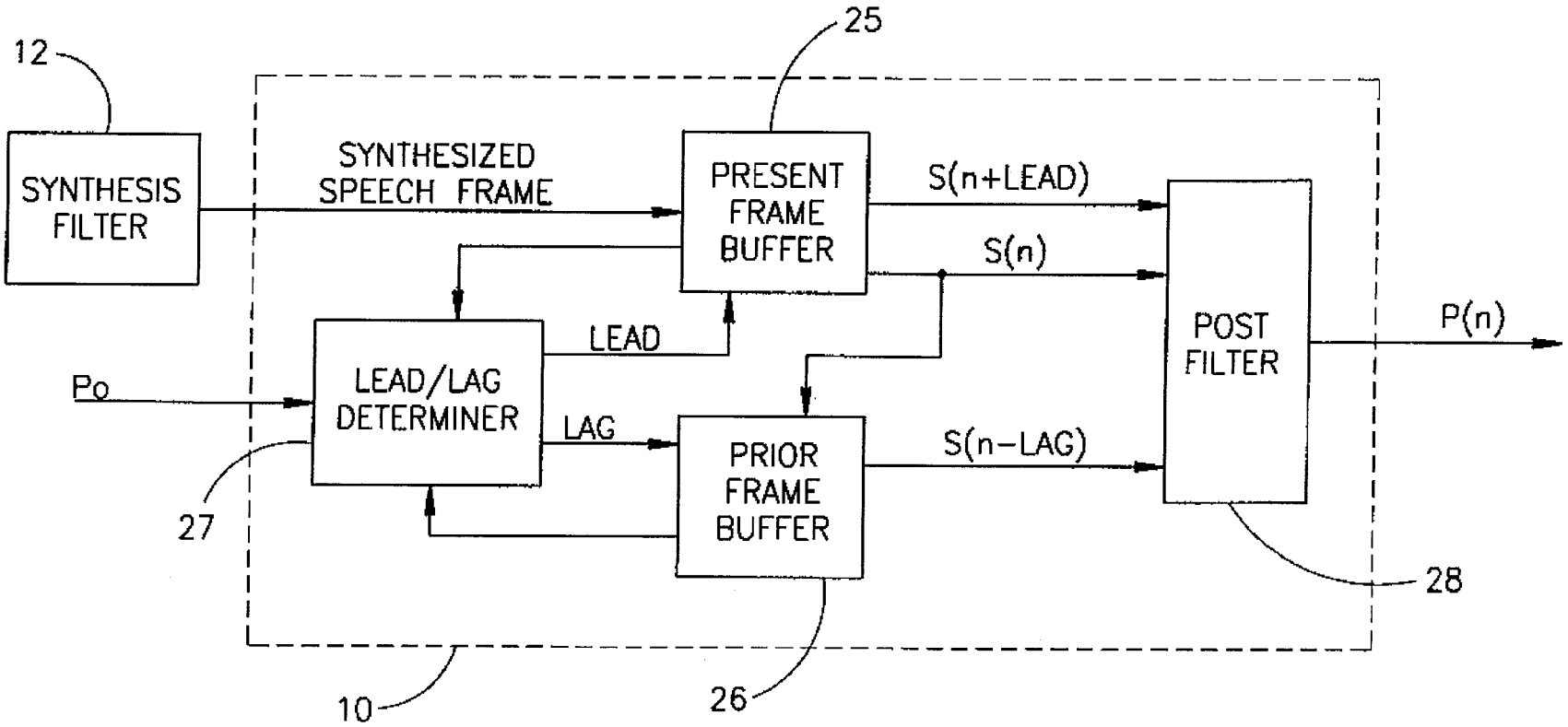
FIG. 1 is a block diagram illustration of a system having the pitch post-filter of the present invention.
Figure 2:
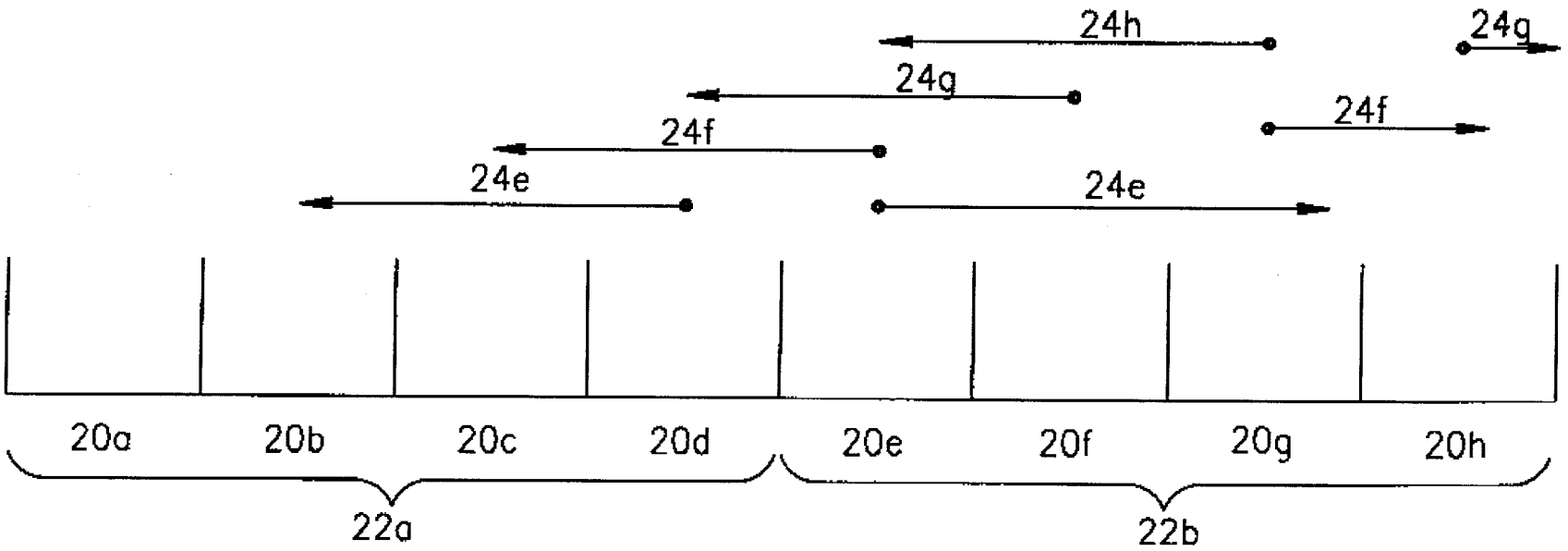
FIG. 2 is a schematic illustration useful in understanding the pitch post-filter of FIG. 1.

Reference is now made to FIGS. 1, 2 and 3 which are helpful in understanding the operation of the pitch post-filter of the present invention.

As shown in FIG. 1, the pitch post-filter, labeled 10, of the present invention receives frames of synthesized speech from a synthesis filter 12, such as a linear prediction coefficient (LPC) synthesis filter. The pitch post-filter 10 also receives the value of the pitch which was received from the speech encoder. The pitch post-filter 10 does not have to be the first post-filter; it can also received post-filtered synthesized speech frames.

Filter 10 comprises a present frame buffer 25, a prior frame buffer 26, a lead/lag determiner 27 and a post filter 28. The present frame buffer 25 stores the present frame of synthesized speech and its division into subframes. The prior frame buffer 26 stores prior frames of synthesized speech. The lead/lag determiner 27 determines the lead and lag indices described hereinabove from the pitch value $p_0$. Post filter 28 receives the subframe s[n] and the future window s[n+LEAD] from the present frame buffer 25 and the prior window s[n−LAG] from the prior frame buffer 26 and produces a post-filtered signal therefrom.

It will be appreciated that the synthesis filter 12 synthesizes frames of synthesized speech and provides them to the pitch post-filter 10. Like prior art pitch post-filters, the filter of the present invention operates on subframes of the synthesized speech. However, since, as Applicants have realized, the entire frame of synthesized speech is available in present frame buffer 25 when processing the subframes, the pitch post-filter 10 of the present invention also utilizes future information for at least some of the subframes.

This is illustrated in FIG. 2 which shows eight subframes **20*a*–20*h* of two frames 22*a* and 22*b*, respectively stored in present frame buffer 25 and prior frame buffer 26. Also shown are the locations from which similar subframes of data can be taken for the later sub frames 20e–20h. As shown by arrows 24e, for the first subframe 20e, data can be taken from previous sub flames 20d, 20c and 20b and from future subframes 20e, 20f and 20g. As shown by arrows 24f, for the second subframe 20f, data can be taken from previous subframes 20e, 20d and 20c and from future subframes 20f, 20g and 20h. It is noted that, for the later subframes 20g and 20h, there is less future data which can be utilized (in fact, for subframe 20h** there is none) but there is the same amount of past data which can be utilized.

The lead/lag determiner 27 of the present invention searches in the past and future synthesizeds speech signals, separately determining for them a lag and lead sample position, or index, respectively, at which subframe length windows of the past and future signal, beginning at the lag and lead samples, respectively, most closely matches the present subframe. If the match is poor, the window is not utilized. Typically, the search range is within 20–146 samples before or after the present sub frame, as indicated by arrows 24. The search range is reduced for the future data (e.g. for subframes 20g and 20h).

The post-filter 28 then post-filters the synthesized speech signal using whichever or both of the matched windows.

One embodiment of the pitch post-filter of the present invention is illustrated in FIG. 3 which is a flow chart of the operations for one subframe. Steps 30–74 are performed by the lead/lag determiner 27 and steps 76 and 78 are performed by the post-filter 28.

The method begins with initialization (step 30), where minimum and maximum lag/lead values are set as is a minimum criterion value. In this embodiment, the minimum lag/lead is min(pitch value–delta, 20) and the maximum lag/lead is max(pitch value+delta, 146). In this embodiment, delta equals 3.

Steps 34–44 determine a lag value and steps 60–70 determine the lead value, if there is one. Both sections perform similar operations, the first on past data, stored in prior frame buffer 26 and the second on future data, stored in present frame buffer 25. Therefore, the operations will be described hereinbelow only once. The equations, however, are different, as provided hereinbelow.

In step 32, the lag index M_g is set to the minimum value and, in steps 34 and 36, the gain g_g associated with the lag index M_g and the criterion E_g for that lag index are determined. The gain g_g is the ratio of the cross-correlation of the subframe s [n] and a previous window s[n–M_g] with the autocorrelation of the previous window s[n–M_g], as follows:

$$g_g=\Sigma s[n]*s[n-M_g]/\Sigma s^2[n-M_g],\ 0\leqq n\leqq 59 \quad (1)$$

The criterion E_g is the energy in the error signal s[n]–g_g*s[n–M_g], as follows:

$$E_g=\Sigma(s[n]-g_g*s[n-M_g]^2, 0\leqq n\leqq 59 \quad (2)$$

If the resultant criterion is less than the minimum value previously determined (step 38), the present lag index M_g and gain g_g are stored and the minimum value set to the present gain (step 40). The lag index is increased by one (step 42) and the process repeated until the maximum lag value has been reached.

In steps 46–50, the result of the lag determination is accepted only if the lag gain determined in steps 34–44 is greater or equal than a predetermined threshold value which, for example, might be 0.625. In step 46, the lag enable flag is initialized to 0 and in step 48, the lag gain g_g is checked against the threshold. In step 50, the result is accepted by setting a lag enable flag to 1. Thus, for a previous speech signal which is not similar to the present subframe, for example if the present subframe has speech and the previous does not, the data from the previous subframe will not be utilized.

In steps 52–56, a lead enable flag is set only if the sum of the present position N, the length of a subframe (typically 60 samples long) and the maximum lag/lead value are less than a frame long (typically 240 samples long). In this way, future data is only utilized if enough of it is available. Step 52 initializes the lead enable flag to 0, step 54 checks if the sum is acceptable and, if it is, step 56 sets the lead enable flag to 1.

In step 58, the minimum value is reinitialized and the lead index is set to the minimum lag value. As mentioned above, steps 60–70 are similar to steps 34–44 and determine the lead index which best matches the subframe of interest. The lead is denoted M_d, the gain is denoted g_d and the criterion is denoted E_d and they are defined in equations 3 and 4, as follows:

$$g_d=\Sigma s[n]*s[n+M_d]/\Sigma s^2[n+M_d], 0\leqq n\leqq 59 \quad (3)$$

$$E_d=\Sigma(s[n]-g_d*s[n+M_d])^2,\ 0\leqq n\leqq 59 \quad (4)$$

Step 60 determines the gain g_d, step 62 determines the criterion E_d, step 64 checks that the criterion E_d is less than the minimum value, step 66 stores the lead M_d and the lead gain g_g and updates the minimum value to the value of E_d. Step 68 increases the lead index by one and step 70 determines whether or not the lead index is larger than the maximum lead index value.

In steps 72 and 74, the lead enable flag is disabled (step 74) if the lead gain determined in steps 60–70 is too low (e.g. lower than the predetermined threshold), which check is performed in step 72.

In step 76 lag and lead weights w_g and w_d, respectively are determined from the lag and lead enable flags. The weights w_g and w_d define the contribution, if any, provided by the future and past data.

In this embodiment, the lag weight w_g is the maximum of the (lag enable–(0.5*lead enable)) and 0, multiplied by 0.25. The lead weight w_d is the maximum of the (lead enable–(0.5*lag enable)) and 0, multiplied by 0.25. In other words, the weights w_g and w_d are both 0.125 when both future and past data are available and match the present subframe, 0.25 when only one of them matches and 0 when neither matches.

In step 78, the output signal p[n], which is a function of the signal s[n], the earlier window s[n–M_g] and a future window s[n+M_d], is produced. M_g and M_d are the lag and lead indices which have been in storage. Equations 5 and 6 provide the function for signal p[n] for the present embodiment.

$$p[n]=g_p*\{s[n]+w_g*g_g*s[n-M_g]+w_d*g_d*s[n+M_d]\}=g_p*p'[n] \quad (5)$$

$$g_p=sqrt[\Sigma s^2[n]/\Sigma p'^2[n], 0\leqq n\leqq 59 \quad (6)$$

Steps 30–78 are repeated for each subframe.

It will be appreciated that the present invention encompasses all pitch post-filters which utilize both future and past information.

It will be appreciated by persons skilled in the art that the present invention is not limited to what has been particularly shown and described hereinabove. Rather the scope of the present invention is defined by the claims which follow:

We claim:

1. A method for pitch post-filtering of synthesized speech comprising the steps of:

receiving a frame of synthesized speech which is divided into a plurality of subframes and a pitch value associated with said frame; and for each subframe of said frame of synthesized speech, producing an output signal which is a pitch post-filtered version of the present subframe filtered with a selected one of the group consisting of prior and future data of said synthesized speech and future data of said synthesized speech, wherein said prior data lags the present subframe by a lag index and wherein said future data leads the present subframe by a lead index, wherein said lead and lag indices are based on said pitch value.

2. A method according to claim 1 and wherein said step of producing comprises the steps of:

matching a subframe long, prior window of said prior synthesized speech, beginning at said lag index, to said subframe;

accepting said matched prior window only when an error between said subframe and a weighted version of said prior window is below a threshold;

if there is enough future synthesized speech, matching a subframe long, future window of said future synthesized speech, beginning at said lead index, to said subframe;

accepting said matched future window only when an error between said subframe and a weighted version of said future window is below a threshold; and creating said output signal by post-filtering said subframe with a selected one of the group consisting of said prior and future window and said future window.

3. A method according to claim 2 and wherein said steps of matching comprise the steps of determining a prior and future gain for said prior and future windows, respectively.

4. A method according to claim 3 and wherein said step of creating comprises the step of:

determining a signal which is the sum of said subframe, said prior window of synthesized speech weighted by said prior gain and a first enabling weight, and said future window of synthesized speech weighted by said future gain and a second enabling weight.

5. A method according to claim 4 and wherein said first and second enabling weights depend on the output of said steps of accepting.

6. A pitch post filter for pitch post-filtering of synthesized speech, the pitch post filter comprising:

means for receiving a frame of synthesized speech which is divided into a plurality of subframes and a pitch value associated with said frame; and means for producing, for each subframe of said frame of synthesized speech, an output signal which is a pitch post-filtered version of the present subframe filtered with a selected one of the group consisting of prior and future data of said synthesized speech and future data of said synthesized speech, wherein said prior data lags the present subframe by a lag index and wherein said future data leads the present subframe by a lead index, wherein said lead and lag indices are based on said pitch value.

7. A filter according to claim 6 and wherein said means for producing comprises:

first matching means for matching a subframe long, prior window of said prior synthesized speech, beginning at said lag index, to said subframe;

first comparison means for accepting said matched prior window only when an error between said subframe and a weighted version of said prior window is below a threshold;

second matching means, operative if there is enough future synthesized speech, for matching a subframe long, future window of said future synthesized speech, beginning at said lead index, to said subframe;

second comparison means for accepting said matched future window only when an error between said subframe and a weighted version of said future window is below a threshold; and filtering means for creating said output signal by post-filtering said subframe with a selected one of the group consisting of said prior and future windows and said future window.

8. A filter according to claim 7 and wherein said first and second matching means comprise the gain determiners for determining a prior and future gain for said prior and future windows, respectively.

9. A filter according to claim 8 and wherein said filtering means comprises means for determining a signal which is the sum of said subframe, said prior window of synthesized speech weighted by said prior gain and a first enabling weight, and said future window of synthesized speech weighted by said future gain and a second enabling weight.

10. A filter according to claim 9 and wherein said first and second enabling weights depend on the output of said first and second comparison means.

* * * * *